US007451742B2

(12) United States Patent
Gibson et al.

(10) Patent No.: US 7,451,742 B2
(45) Date of Patent: Nov. 18, 2008

(54) ENGINE HAVING COMMON RAIL INTENSIFIER AND METHOD

(75) Inventors: Dennis H. Gibson, Chillicothe, IL (US); Mark F. Sommars, Sparland, IL (US); Hoisan Kim, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/978,255

(22) Filed: Oct. 29, 2007

(65) Prior Publication Data

US 2008/0098988 A1 May 1, 2008

(51) Int. Cl.
*F02M 69/46* (2006.01)
*F02M 69/50* (2006.01)

(52) U.S. Cl. ..... 123/446; 123/456; 417/225

(58) Field of Classification Search ..... 123/495, 123/446, 447, 456, 459, 467; 417/225, 226, 417/227; 239/88–92
See application file for complete search history.

(56) References Cited

U.S. PATENT DOCUMENTS 4,021,156 A * 5/1977 Fuchs et al. ..... 417/346
5,546,912 A 8/1996 Yamada et al.
5,634,773 A * 6/1997 Tanino et al. ..... 417/46
5,639,218 A * 6/1997 Tanino et al. ..... 417/3
5,964,406 A 10/1999 Zuo
6,113,361 A 9/2000 Djordjevic
6,234,148 B1 * 5/2001 Hartke et al. ..... 123/447
6,439,193 B2 * 8/2002 Lehtonen ..... 123/299
6,497,215 B1 12/2002 Gaessler et al.
6,786,205 B2 9/2004 Stuhldreher et al.
6,899,088 B2 5/2005 Djordjevic
7,179,060 B2 2/2007 Sommare et al.
2003/0183197 A1 * 10/2003 de Ojeda ..... 123/446
2007/0039590 A1 * 2/2007 Gray ..... 123/446

* cited by examiner

*Primary Examiner*—Mahmoud Gimie
(74) *Attorney, Agent, or Firm*—Liell & McNeil

(57) ABSTRACT

An internal combustion engine includes an engine housing, a common rail, and a pressurization device for the common rail which includes a plurality of intensifier pistons, and an hydraulically actuated control valve movable between a first position at which it fluidly connects a source of pressurized actuation fluid with one of said intensifier pistons but not a second one of the intensifier pistons, and a second position at which it fluidly connects the at least one fluid inlet with the second one of the intensifier pistons but not the first one of the intensifier pistons.

20 Claims, 6 Drawing Sheets

ENGINE HAVING COMMON RAIL INTENSIFIER AND METHOD

TECHNICAL FIELD

The present disclosure relates generally to engines having common rail fuel systems, and relates more particularly to controlling an intensifier positioned upstream of a common rail via an hydraulically actuated valve.

BACKGROUND

Common rail fuel systems are well known and widely used in modern internal combustion engines. In general, a pressurized fluid is supplied to a common rail, having a plurality of fuel injectors fluidly connected therewith. High pressure fluid from the common rail may be used to actuate the injectors, for injecting a fuel into engine cylinders. The pressurized fluid within the rail may be fuel, which not only actuates the injectors but is also injected into the associated cylinders, or the fluid in the rail may be an actuation fluid separate from the fuel which is injected. In many applications, common rail systems tend to offer superior control and efficiency over strategies which rely on individual pumps associated one with each of the fuel injectors.

Over the years, many improvements in fuel system design and operation have relied at least in part upon the ability to inject a fuel into engine cylinders at increasingly higher pressures. Higher pressures in the rail tend to enable higher injection pressures and also relatively precise control over injection initiation and cessation, and improved fuel atomization. A shortcoming of increasing rail pressure, however, is the additional energy required to pressurize the actuation fluid which is supplied to the common rail. Furthermore, pumps and other system components may work at less than optimal efficiency, and can even wear more quickly, when operated to provide relatively high fluid pressures. Further still, the higher the system pressure, the higher the noise created during operation and typically the higher the resulting drive torque fluctuation. Thus, there is ample room for improvement over traditional common rail designs, particularly as the required system pressure thresholds are pushed ever higher.

U.S. Pat. No. 6,786,205 to Stuhldreher et al. sets forth one common rail strategy wherein fluid for the rail is pressurized with hydraulic intensifiers positioned between a fluid supply and the common rail. Stuhldreher et al. purportedly can substitute for systems wherein hydraulic intensification is carried out within each individual fuel injector, reducing the number of parts. While this might be the case in certain instances, Stuhldreher actually increases system complexity at different locations, namely, requiring a relatively complex system of control valves for the intensification units.

SUMMARY

In one aspect, an internal combustion engine includes an engine housing having a plurality of cylinders therein, a common rail and a plurality of fuel injectors fluidly connected with the common rail and each associated with one of the cylinders. The engine further includes a pressurization device for the common rail which includes a housing having a plurality of intensifier pistons disposed at least partially therein, at least one fluid inlet and at least one fluid outlet connected with the common rail. A supply of pressurized actuation fluid for the intensifier pistons is fluidly connected with the at least one fluid inlet. The engine further includes an hydraulically actuated valve movable between a first position at which it fluidly connects the at least one fluid inlet with a first one of the intensifier pistons but not a second one of the intensifier pistons, and a second position at which it fluidly connects the at least one fluid inlet with the second one of the intensifier pistons but not the first one of the intensifier pistons.

In another aspect, a method of pressurizing a common rail fuel system of an internal combustion engine includes the steps of moving a first intensifier piston via a pressurized actuation fluid, and moving a second intensifier piston via a pressurized actuation fluid. The method further includes a step of hydraulically moving a valve between a first position at which it connects the first intensifier piston with a source of pressurized actuation fluid but blocks the second intensifier piston from the source of pressurized actuation fluid and a second position at which it connects the second intensifier piston with the source of pressurized actuation fluid but blocks the first intensifier piston from the source of pressurized actuation fluid. The method still further includes a step of supplying a fluid to a common rail which is pressurized at least in part via the steps of moving the first and second intensifier pistons.

In still another aspect, a pressurization device for a common rail fuel system of an internal combustion engine includes a housing having at least one actuation fluid inlet, and at least one outlet. A first intensifier is provided including a first actuation chamber, and a first piston positioned at least partially within the housing. A second intensifier is provided and includes a second actuation chamber, and a second piston positioned at least partially within the housing. The pressurization device still further includes a valve having a first position wherein the actuation fluid inlet is in fluid communication with the first actuation chamber but not the second actuation chamber, and a second position wherein the actuation fluid inlet is in fluid communication with the second actuation chamber but not the first actuation chamber. The valve further includes at least one pressure control surface for moving the valve between the first and second positions.

DETAILED DESCRIPTION

Figure 1:
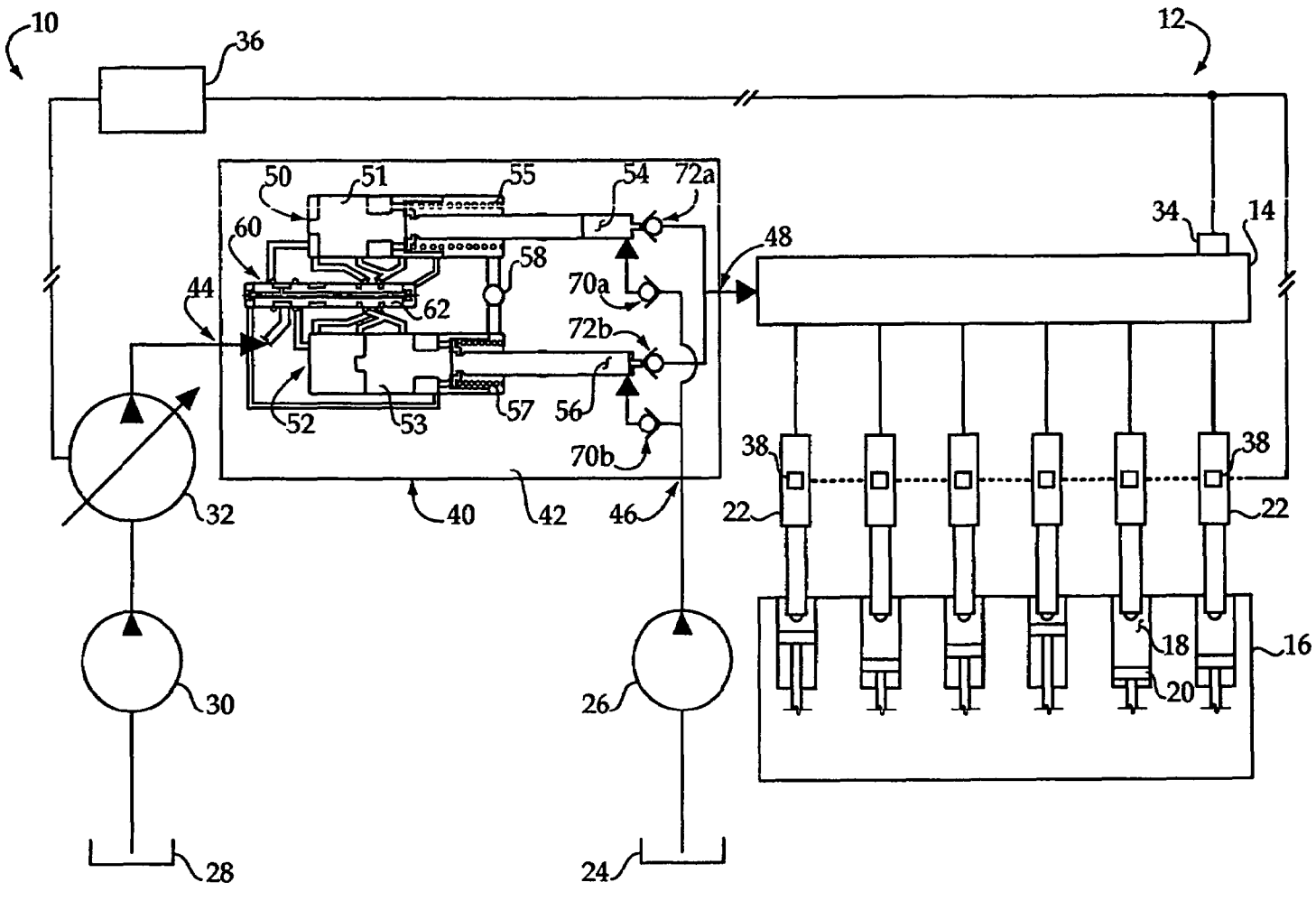
FIG. 1 is a diagrammatic view of an engine system, according to one embodiment.

Referring to FIG. 1, there is shown an engine system 10 according to the present disclosure. Engine system 10 may be a compression ignition engine system, such as a diesel engine system, but might comprise another type such as a spark-ignited engine system in certain embodiments. Engine system 10 includes an engine 12, having an engine housing 16 with a plurality of cylinders 18 therein. A plurality of pistons 20 are associated one with each of cylinders 18. A plurality of fuel injectors 22 are also associated one with each of cylinders 18, and may extend at least partially into the corresponding cylinder 18 in certain embodiments. Each of fuel injectors 22 is fluidly connected with a common rail 14, and may include an actuator 38 therein for controlling fuel injection in a conventional manner. Each of actuators 38 may be a piezoelectric actuator, or some other type of electrical actuator such as a solenoid actuator. Each of actuators 38 is electrically connected with an electronic control unit 36, such as an engine controller, or another control device. A pressure sensor 34 may be coupled with common rail 14 and configured to sense a fluid pressure property such as fluid pressure, change in fluid pressure, rate of change in fluid pressure, etc., of common rail 14 and output signals to electronic control unit 36. Electronic control unit 36 may be in control communication with a source of pressurized actuation fluid 32, such as an actuation fluid supply pump, the significance of which will be apparent from the following description. A pressurization device 40 is positioned upstream of common rail 14 and may be used to pressurize a fluid prior to supplying the fluid to common rail 14, as further described herein. The design and operation of pressurization device 40 is contemplated to provide advantages with regard to efficiency, simplicity and other factors over state of the art common rail fuel systems, as further described herein.

Engine system 10 may further include a fuel supply 24 and a fuel transfer pump 26 connected therewith which is configured to supply a fuel to device 40 via an inlet 46 in a housing 42 of device 40. In one embodiment, fuel transfer pump 26 supplies fuel to be pressurized by device 40 at a relatively low pressure. Engine system 10 may further include an oil supply such as an oil sump 28, and an oil transfer pump 30 connected with source 32. In one embodiment, source 32 may comprise a pump (hereinafter "pump 32") such as a variable displacement pump, or a variable speed pump, which has its output controlled by electronic control unit 36. In particular, pump 32 may have one or more actuators to control either the rate of pumping, or the displacement, to vary the quantity and/or pressure of fluid over time which is output from pump 32 to device 40. A spill valve might also be positioned between pump 32 and device 40 in other embodiments to enable varying the amount of fluid supplied thereto. In one embodiment, pump 32 can supply pressurized actuation fluid to device 40 at a medium pressure as compared with the relatively low pressure of fuel from pump 26.

In the illustrated embodiment, device 40 is actuated via oil, and fuel is pressurized by device 40 prior to the fuel being supplied to common rail 14. It should be appreciated that the illustrated embodiment is exemplary only, and fuel might be used both as the actuation fluid for device 40 and the pressurized fluid which is supplied to common rail 14. Alternatively, engine oil could be used both as the actuation fluid for device 40 and also as the pressurized fluid which is supplied to common rail 14, etc. Typically, device 40 will supply pressurized fluid to common rail 14 via at least one outlet 48 at a relatively high pressure as compared to the fluid pressures from pump 32 and pump 26. Still other fluids might be used in connection with pressurizing common rail 14, for example, transmission fluid, brake fluid, etc. might be used as either of the actuation fluid for device 40, or the pressurized fluid which is supplied to common rail 14 and fuel injectors 22.

Intensification device 40 may include a first intensifier 50 having a first intensifier piston 51 positioned at least partially within housing 42, and a second intensifier 52 having a second intensifier piston 53 which is also positioned at least partially within housing 42. Each of intensifiers 50 and 52 may include a pressurization or "intensification" chamber 54 and 56, respectively, which receive fuel, or another fluid, via inlet 46 from transfer pump 26. A first check valve 70*a* and a second check valve 70*b* are fluidly positioned between inlet 46 and intensification chambers 54 and 56, respectively, in the illustrated embodiment. A third check valve 72*a* and a fourth check valve 72*b* are fluidly positioned between chambers 54 and 56, and common rail 14, which enables fuel pressurized in chambers 54 and 56 to be supplied to common rail 14 when pressure in common rail 14 is less than that in chambers 54 and 56.

Pressurization of fuel via intensifiers 50 and 52 will take place by moving each of intensifier pistons 51 and 53 between a first, retracted position, and a second, advanced position. In one embodiment, a first biasing member 55 may be associated with first intensifier piston 51, and a second biasing member 57 may be associated with second intensifier piston 53. Accordingly, movement of each of intensifier pistons 51 and 53 from their first, retracted position toward their second, advanced position will take place against a bias of the corresponding biasing member 55 and 57. Returning of each of pistons 51 and 53 to their respective first positions will take place via a biasing force of biasing members 55 and 57, respectively.

In one embodiment, pistons 51 and 53 are out of phase, such that a first of pistons 51 and 53 is at a retracted position when the other of pistons 51 and 53 is at its advanced position. As mentioned above, electronic control unit 36 may receive signals from sensor 34 which are associated with a fluid pressure property of common rail 14. When fuel injectors 22 are actuated, fluid from common rail 14 will be consumed, reducing its pressure. Depending upon the operating conditions, the rate at which fluid is consumed from rail 14 can vary, for example based upon engine speed and/or load. It will typically be desirable to maintain a relatively steady rail pressure. To this end, electronic control unit 36 can output commands to pump 32 to control the rate at which pistons 51 and 53 reciprocate, in a closed loop fashion based on signals from sensor 34. In other words, displacement of pump 32, or an adjustment in the speed of pump 32, can each vary the flow rate of actuation fluid to device 40 which in turn varies the output of device 40. A drop in pressure in common rail 14 may thus be compensated for by increasing the flow rate of fluid supplied via device 40 to common rail 14 by increasing reciprocation speed of pistons 51 and 53.

Pump 32 will typically be a cam-driven pump, such that its speed is proportional to engine speed. Designs are known, however, wherein a gearbox may be positioned between pump 32 and engine 12, such that the speed of pump 32 can be adjusted by switching between gear ranges independently of engine speed. Similarly, pump displacement may be varied by controlling an outlet device positioned between pump 32 and inlet 44, which would permit a variable amount of fluid pressurized by pump 32 to spill in a known manner, as mentioned above.

One feature of the present disclosure relates to the manner in which intensifiers 50 and 52 are operated via actuation fluid from pump 32. In one embodiment, an hydraulically actuated control valve 60 including a valve member 62 is moved between a first position at which it fluidly connects inlet 44 with a first one of intensifier pistons 51 and 53 but not the second one of pistons 51 and 53, and a second position at which it fluidly connects inlet 44 to the second one of pistons 51 and 53 but not the first one of pistons 51 and 53. Accordingly, valve member 62 may comprise a shuttle valve which shuttles between its first and second positions, alternately supplying pressurized actuation fluid from pump 32 to each of pistons 51 and 53.

Figure 2:
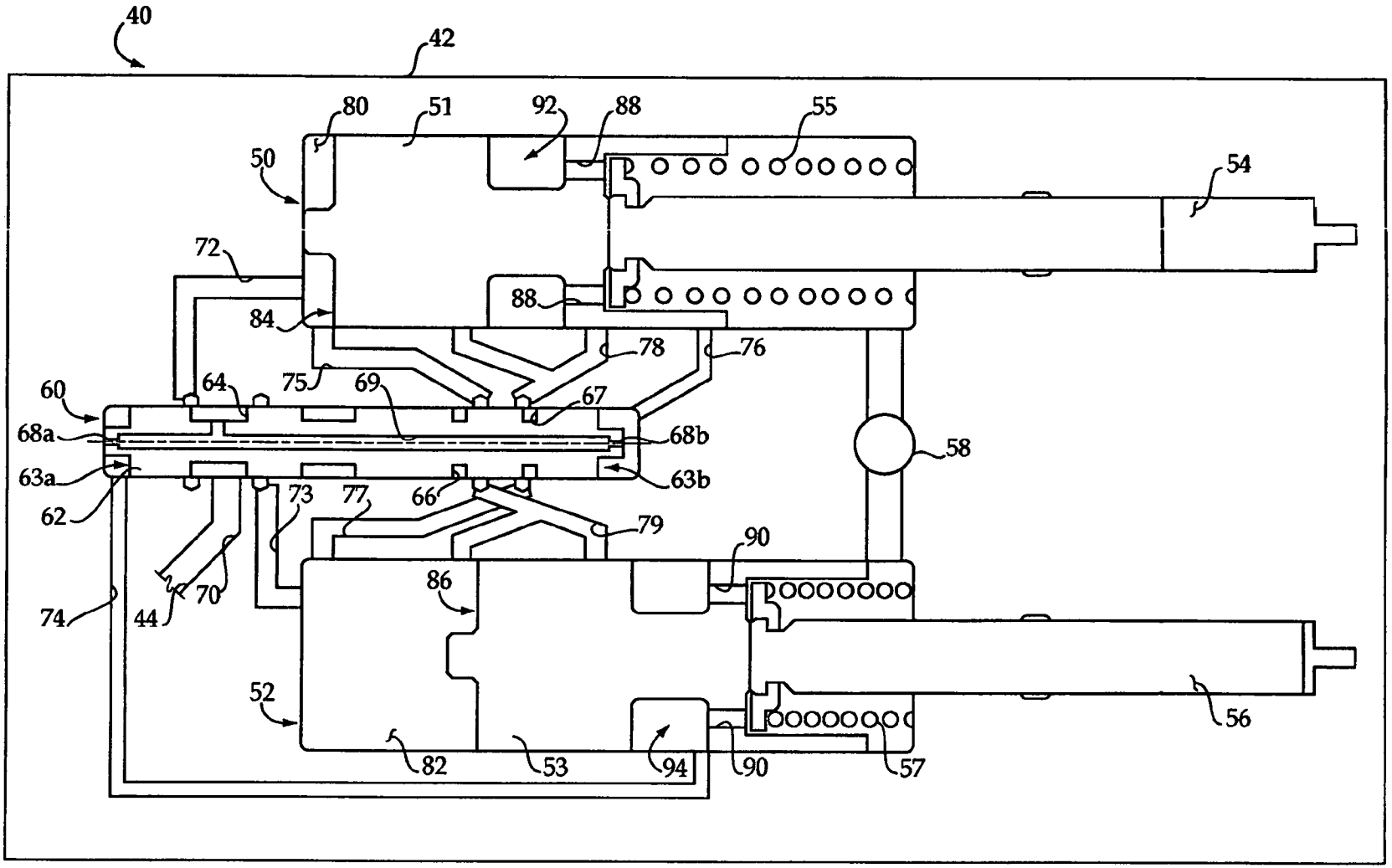
FIG. 2 is a diagrammatic view of a pressurization device for a common rail, in a first configuration.

Turning now to FIG. 2, there are identified certain of the features of pressurization device 40 in more detail. As alluded to above, each of pistons 51 and 53 is actuated via pressurized actuation fluid supplied via inlet 44, or multiple inlets in other embodiments. First intensifier 50 may include an actuation chamber 80 whereby pressurized actuation fluid from inlet 44 can exert hydraulic pressure on a pressure surface 84 of piston 51, to advance piston 51 from its first position, as shown, toward its advanced position, against the biasing force of biasing member 55 to compress fluid in chamber 54. Second intensifier 52 likewise includes an actuation chamber 82 whereby pressurized actuation fluid supplied via inlet 44 can act on a pressure surface 86 to move piston 53 from its first position to its second position, as shown. An inlet passage 70 connects with inlet 44 and communicates pressurized actuation fluid from pump 32 to control valve 60. An annulus 64 in valve member 62 comprises a fluid passage which can connect passage 70 alternately with a first passage 72 connecting to chamber 80 and a second passage 73 connecting to chamber 82. Control valve member 62 is movable between a first position, as shown in FIG. 2 at which annulus 64 fluidly connects passages 70 and 72, and a second position at which annulus 64 fluidly connects passages 70 and 73. In one embodiment, valve member 62 is movable between its first position shown in FIG. 2 and its second position via hydraulic pressure applied to a first control surface or pressure surface 63*a* versus hydraulic pressure applied to a second control surface or pressure surface 63*b* which is opposed to control surface 63*a*.

Moving of valve member 62 between its respective positions may be effected at least in part via pistons 51 and 53. In other words, operation of intensifiers 50 and 52 can cause valve member 62 to shuttle back and forth between its first and second positions at which it alternatively supplies pressurized actuation fluid from inlet 44 to chambers 80 and 82, respectively. In one embodiment, operation of intensifiers 50 and 52 can alternately connect control valve 60 to a low pressure outlet or drain 58 from housing 42. To this end, device 40 may include a first pressure control passage 76 which can connect pressure control surface 63*b* with the low pressure of drain 58 via an annular space 92 and passages 88 of piston 51, when piston 51 is in its advanced position. Another pressure control passage 74 can connect pressure control surface 63*a* with the low pressure of drain 58 when second piston 53 is in its advanced position, as shown in FIG. 2, via an annular space 94 and passages 90 of piston 53 when piston 53 is in its advanced position. When pistons 51 and 53 are in their respective retracted positions, the connection between the corresponding pressure control passage and drain 58 is blocked, as shown with regard to piston 51 in FIG. 2.

In this general manner, reciprocation of pistons 51 and 53 between their advanced and retracted positions alternately connects pressure control passages 76 and 74 with drain 58. Relatively high pressure and relatively low pressure is alternately applied to pressure surfaces 63*a* and 63*b* as pistons 51 and 53 reciprocate back and forth between their retracted and advanced positions, as further described herein. Control valve member 62 may include a first orifice 68*a* and a second orifice 68*b* which each connect with a longitudinal fluid passage 69, in turn connected with annulus 64 to allow high pressure fluid to be supplied to pressure surfaces 63*a* and 63*b*, as dictated by a position of valve member 62, also further described herein. Device 40 may further include a first branching passage 79 which is selectively connected with chamber 80 via another passage 75, based on a position of valve member 62. A second branching passage 78 is selectively connected with chamber 82 via another passage 77, also based on a position of valve member 62.

INDUSTRIAL APPLICABILITY

When device 40 is in the configuration shown in FIG. 2, piston 51 is in its first, retracted position. Piston 53 is in its advanced position, having just completed pressurizing fluid in chamber 56 and has opened pressure control passage 74 to low pressure drain 58 such that valve member 62 has moved to a position at which it fluidly connects inlet passage 70 with chamber 80 via annulus 64. High pressure is thus supplied to chamber 80, imparting a tendency for piston 51 to move away from its retracted position, as shown, toward its advanced position. Chamber 82 is blocked from high pressure, and biasing member 57 is urging piston 53 back toward its retracted position. Chamber 82 is fluidly connected with passage 78 via an annulus 67 of valve member 62. Chamber 54 will typically be at least partially filled with fluid to be pressurized and supplied to rail 14.

Figure 3:
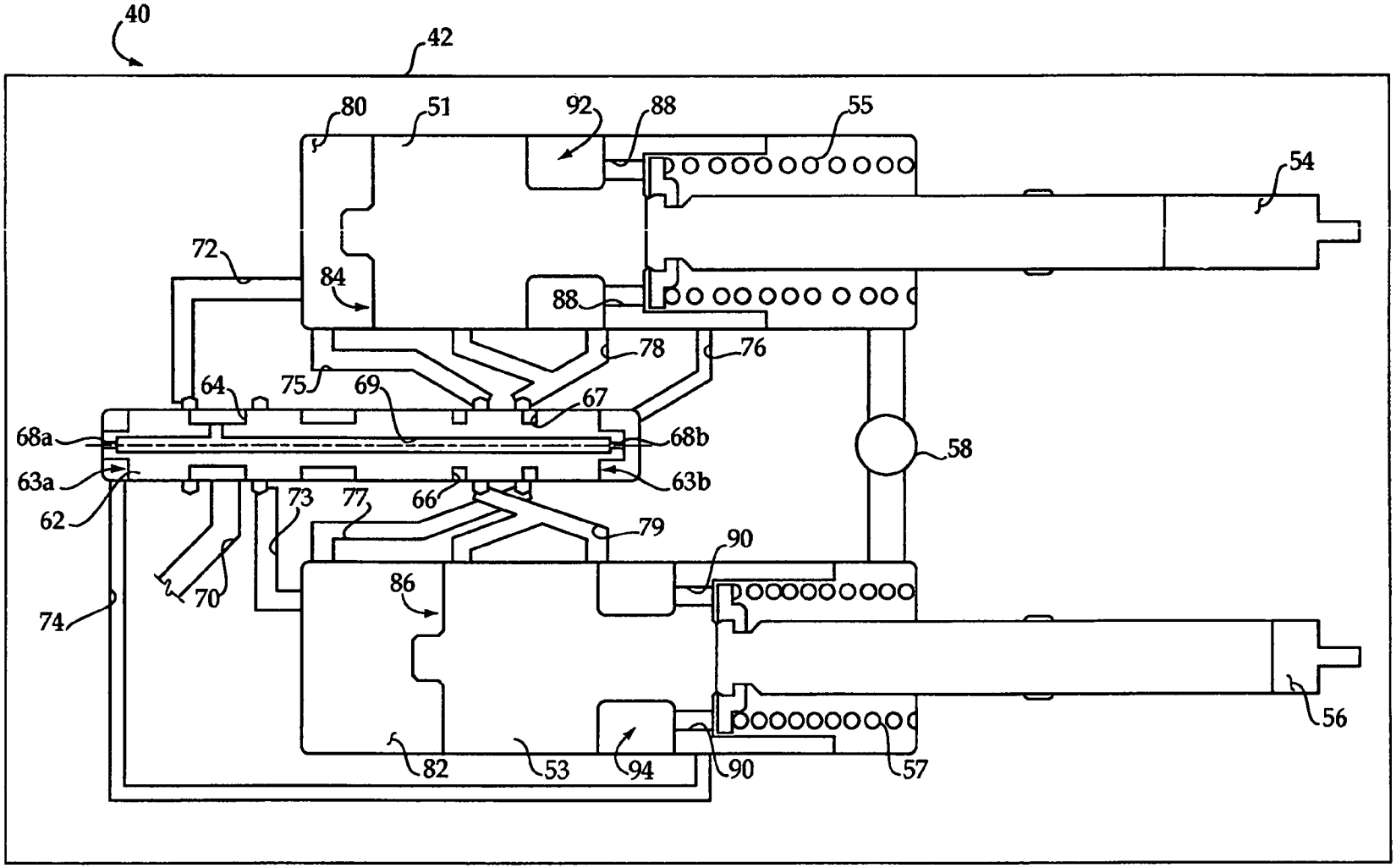
FIG. 3 is a diagrammatic view of a pressurization device as in FIG. 2, shown in another configuration.

From the configuration shown in FIG. 2 piston 51 will tend to move toward its advanced position in response to fluid pressure in chamber 80 acting on surface 84. Piston 53 will tend to move toward its retracted position under the influence of biasing member 57. Referring also to FIG. 3, as piston 53 moves toward its retracted position it will block pressure control passage 74. As piston 51 moves toward its advanced position, it will open passage 78, establishing fluid communications between passage 78 and annular space 92. At the configuration shown in FIG. 3, fluid communications may thus exist between chamber 82 and annular space 92 via passages 77 and 78 via annulus 67. As piston 53 moves leftward in the FIG. 3 illustration, and piston 51 moves rightward, fluid from chamber 82 may be transitioned to annular space 92, and ultimately to drain 58 via passages 88. Valve member 62 may remain at its first position where it provides fluid communications between passage 70 and chamber 80.

Figure 4:
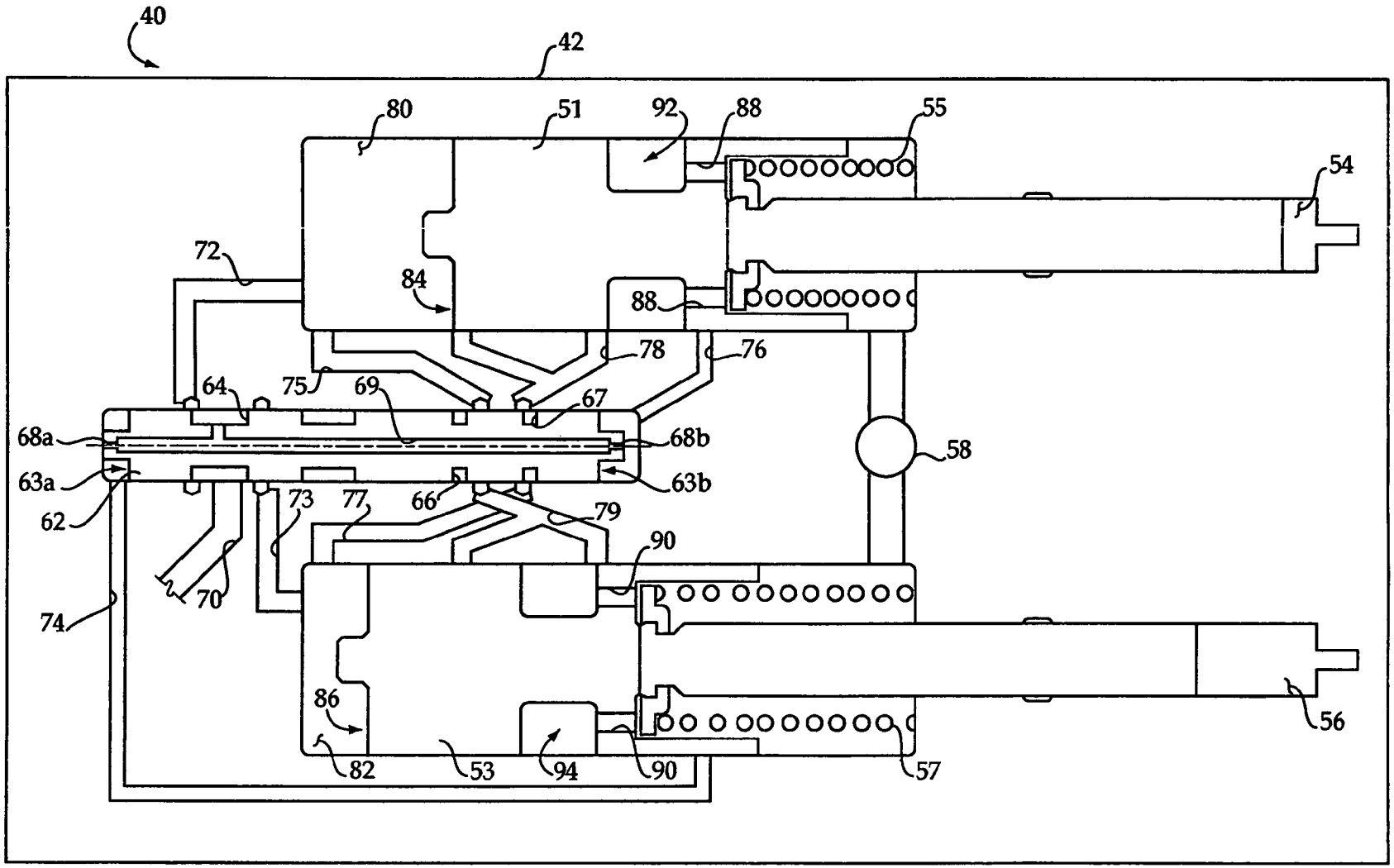
FIG. 4 is a diagrammatic view of a pressurization device as in FIG. 3, shown in another configuration.

Referring to FIG. 4, there is shown device 40 in a configuration where pistons 51 and 53 have moved further toward their respective advanced and retracted positions relative to the configuration shown in FIG. 3. Pressure control passages 74 and 76 remain blocked from drain 58 by their associated pistons 53 and 51, respectively. Valve member 62 fluidly connects inlet passage 70 with chamber 80 via annulus 64. Piston 51 has moved to a position at which it blocks or nearly blocks branching passage 78, and piston 51 is pressurizing fluid in chamber 54.

Figure 5:
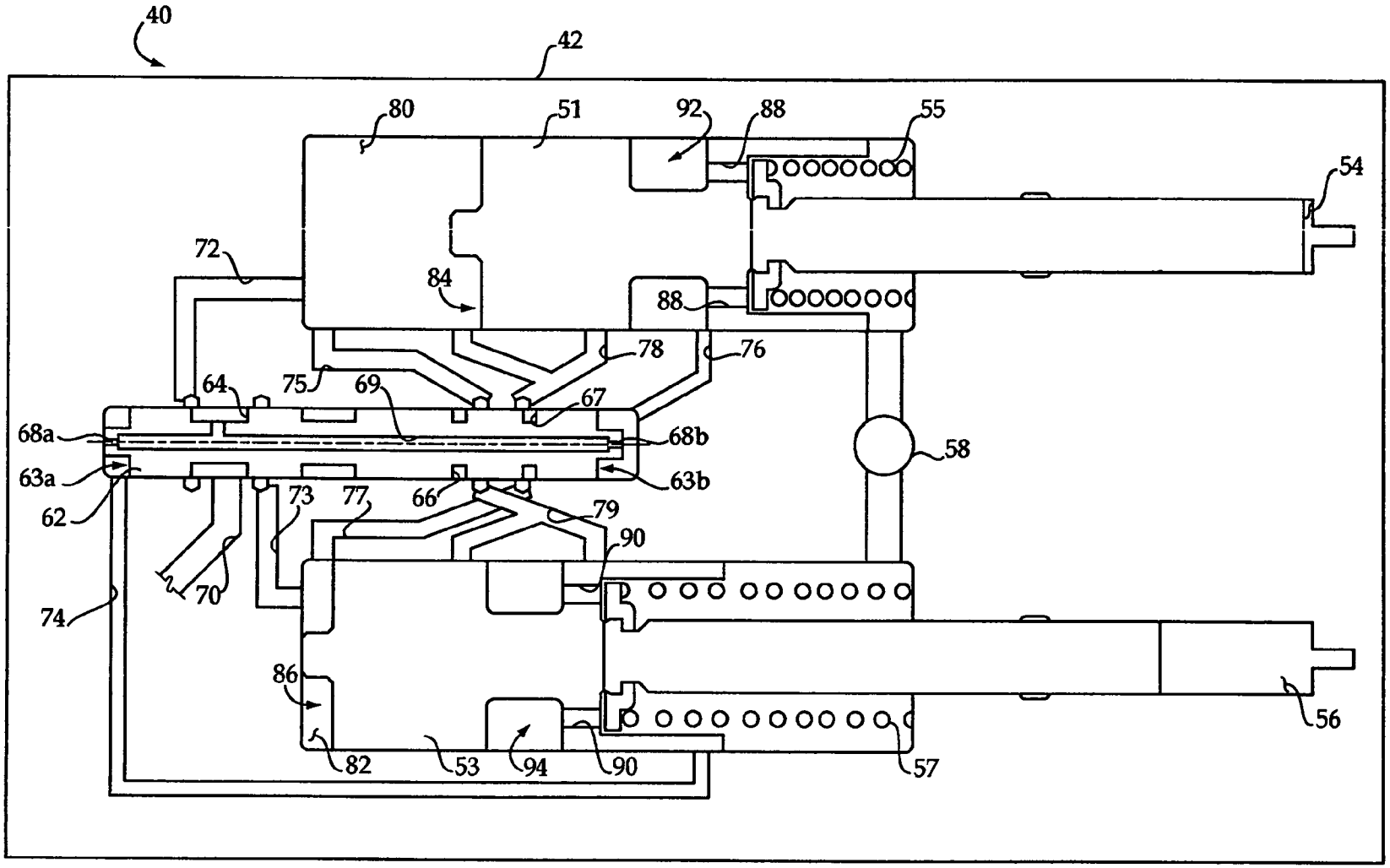
FIG. 5 is a diagrammatic view of a pressurization device as in FIG. 4, shown in yet another configuration.

Turning to FIG. 5, there is shown device 40 in another configuration wherein piston 51 is at its advanced position, having just completed pressurizing fluid in chamber 54, and piston 53 has returned to its retracted position. Piston 51 has moved to open fluid communications between chamber 80 and branching passage 78, which may still be in fluid communication with passage 77 and chamber 82 via annulus 67. Piston 53 blocks branching passage 79, and pressure control passage 74. Valve member 62 is still in its first, leftward position wherein it fluidly connects inlet passage 70 with chamber 80. It will be noted that piston 51 has moved to a position at which it no longer blocks pressure control passage 76 and, accordingly, pressure surface 63*b* may be exposed to the relatively low pressure of drain 58. It will be recalled that passage 69 will typically always be in fluid communications with inlet passage 70, which supplies high pressure fluid. Pressure control passage 74 is blocked from drain 58 and, hence, the fluid pressure applied to pressure surface 63*a* may begin to rise relative to the fluid pressure applied to surface 63*a*, as high pressure fluid will continue to be supplied via passage 69 and orifice 68*a*. Accordingly, from the configuration shown in FIG. 5, valve member 62 may be urged toward a second position, rightward in the FIG. 5 illustration.

Figure 6:
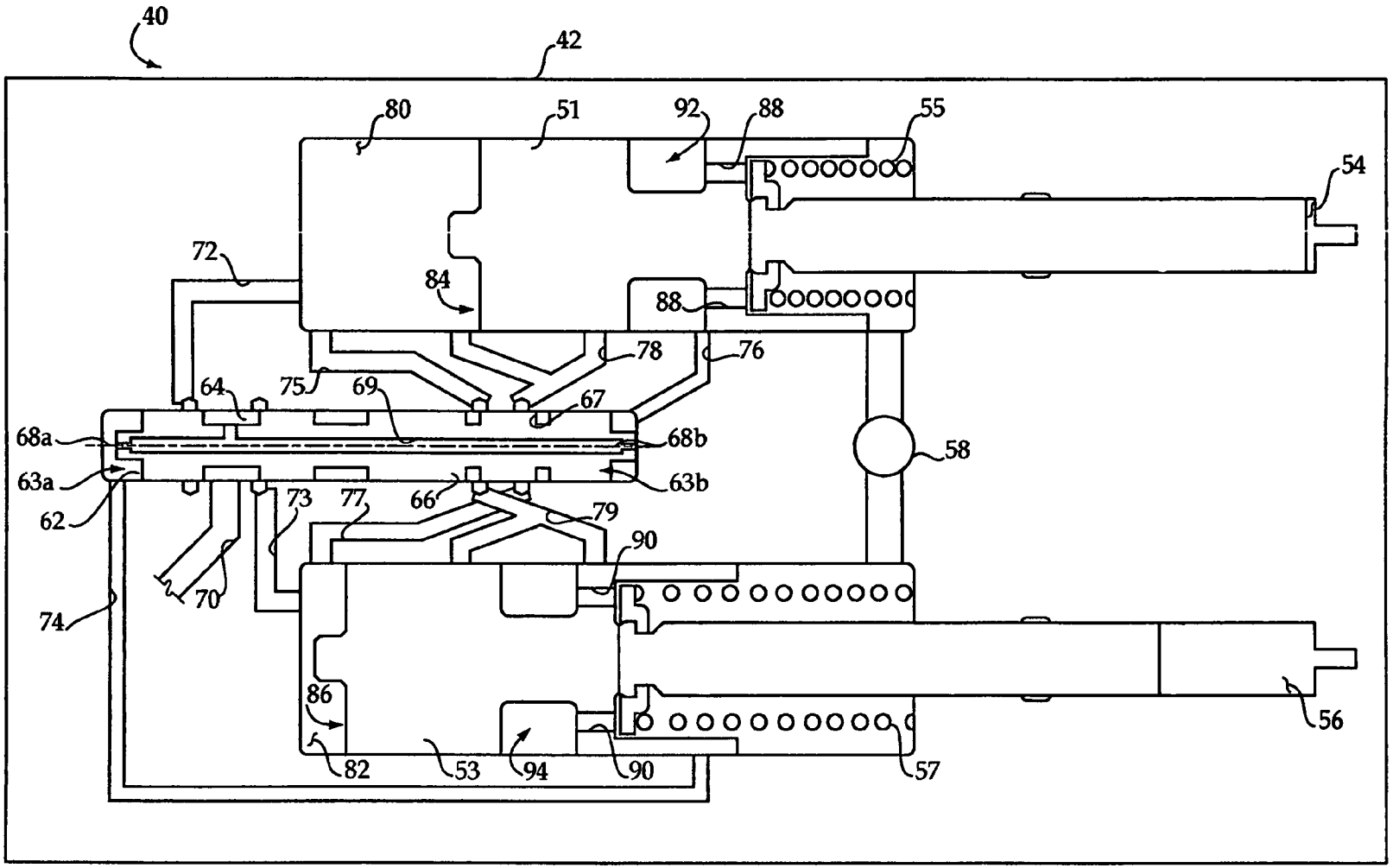
FIG. 6 is a diagrammatic view of a pressurization device as in FIG. 5 shown in yet another configuration.

Turning to FIG. 6, there is shown device 40 in a configuration where valve member 62 has moved to the right and now fluidly connects chamber 82 with inlet passage 70 via annulus 64. Piston 51 has begun to return toward its retracted position but has yet to completely block pressure control passage 76 which remains at a relatively low pressure. Piston 53 has begun to move toward its advanced position under the influence of high pressure in chamber 82 acting on surface 86. Pressure control passage 74 is blocked by piston 53, and hence at a relatively high pressure. In the position shown in FIG. 6, valve member 62 may also fluidly connect branching passage 79 with passage 75 via annulus 66, though branching passage 79 remains blocked by piston 53.

From the configuration shown in FIG. 6, pistons 51 and 53 will complete their respective retracting and advancing motions. Piston 53 will once again move to a position at which it opens pressure control passage 74 to drain 58, and valve member 62 will move back toward its first position shown in FIG. 2. It will thus be appreciated that control valve 60 can perform its intended control function of alternately supplying high pressure fluid to chambers 80 and 82 to effect actuation of pistons 51 and 53 to pressurize fluid in chambers 54 and 56, respectively, for supplying to rail 14. It will further be appreciated that control over the state of valve 60 may be linked to positions of pistons 51 and 53. In one embodiment, all that is necessary for device 40 to operate is supplying pressurized fluid via inlet passage 70. No electronic control or electrically powered actuators are required, although in certain contemplated embodiments they might be included.

Device 40 may thus operate entirely hydraulically, and has the added advantage of being able to initiate operation regardless of the state it is in when operation is suspended. In other words, when engine system 10 is shut down, then restarted, device 40 will begin to operate in its intended manner automatically as soon as pressurized fluid is supplied thereto. These and other features differ from and improve upon earlier systems wherein relatively complicated electronic control valve strategies, as well as the associated control logic and hardware are used. In many cases, a common rail system which utilizes pressure sensing of the rail to control a rail supply pump can be operated via the same or similar control logic used prior to incorporating a device such as device 40. Thus, it may be possible in many instances to utilize existing control software and hardware for controlling a system having device 40 therein, as the output of a pump such as pump 32 to pressurization device 40 may be controlled in a manner similar to that used in systems where the pump directly supplied the rail.

The present disclosure offers the further advantages of providing a system and operating strategy wherein certain of the system components may be operated as efficiently as is practicable. For example, using piezoelectric actuators as actuators 38 is contemplated to provide a system wherein very little leakage and, hence, wasted energy, occurs. Moreover, actuators 38 may comprise the highest pressure dynamic component of system 10, where piezoelectric actuators are used this can provide for maximum pressure capability and improved efficiency over solenoid actuators and the like. Pump 32 can also operate at a relatively lower pressure than in other common rail systems and thus is associated with reduced drive torque fluctuation and lower system noise. Certain of the components may also be tuned such they operate in their most efficient range. For instance, the outlet pressure requirement for pump 32 may generally be based on an intensification ratio of device 40. Intensification ratio for each of intensifiers 50 and 52 will typically be approximately equal to a diameter of the corresponding piston, i.e. of surfaces 84 and 86, divided by a diameter of the plunger which pressurizes fluid in the corresponding chamber 54 and 56, squared, and multiplied by the inlet pressure to device 40. In designing a system according to the present disclosure, the dimensions described above may be varied relatively easily such that a pressure range for pump 32 may be set which is optimally efficient.

The present description is for illustrative purposes only, and should not be construed to narrow the breadth of the present disclosure in any way. Thus, those skilled in the art will appreciate that various modifications might be made to the presently disclosed embodiments without departing from the full and fair scope of the present disclosure. For example, while device 40 is shown in the context of a dual-piston pressurization device, the present disclosure is not thereby limited, and in other embodiments a greater number of pistons might be used. Further, while two hydraulic control surfaces 63*a* and 63*b* are shown in connection with valve 60, in other embodiments a single hydraulic control surface and an electrical actuator might be used. Other aspects, features and advantages will be apparent upon an examination of the attached drawings and appended claims.

What is claimed is:

1. An internal combustion engine comprising:

an engine housing having a plurality of cylinders therein;

a common rail;

a plurality of fuel injectors fluidly connected with said common rail and each associated with one of said cylinders;

a pressurization device for said common rail which includes a housing having a plurality of intensifier pistons disposed at least partially therein, at least one fluid inlet, and at least one fluid outlet connected with said common rail, said plurality of intensifier pistons being configured to reciprocate within said housing;

a source of pressurized actuation fluid for said intensifier pistons fluidly connected with said at least one fluid inlet, said source of pressurized actuation fluid having an adjustable flow output and said plurality of intensifier pistons having a reciprocation speed within said housing which is based at least in part on the adjustable flow output;

an hydraulically actuated valve movable between a first position at which it fluidly connects said at least one fluid inlet with a first one of said intensifier pistons but not a second one of said intensifier pistons, and a second position at which it fluidly connects said at least one fluid inlet with the second one of said intensifier pistons but not the first one of said intensifier pistons; and a control device coupled with said source of pressurized actuation fluid and configured to control a fluid pressure in said common rail at least in part by varying the reciprocation speed of said plurality of intensifier pistons via adjusting the flow output of said source of pressurized actuation fluid.

2. The engine of claim 1 wherein said valve comprises a shuttle valve having a first hydraulic control surface and a second hydraulic control surface opposed to said first hydraulic control surface.

3. The engine of claim 2 wherein said housing includes a first actuation chamber and a second actuation chamber for said first and second intensifier pistons, respectively, and wherein said valve includes at least one passage which alternately connects said at least one fluid inlet with said first and second actuation chambers at said first and second positions, respectively.

4. The engine of claim 2 wherein said housing includes a first control passage for said shuttle valve which is associated with said first hydraulic control surface, a second control passage for said shuttle valve which is associated with said second hydraulic control surface, and a low pressure drain, and wherein each one of said intensifier pistons is movable between a first position at which it blocks one of said control passages from said drain and an advanced position at which it does not block the one of said control passages.

5. The engine of claim 4 wherein said pressurization device includes a first biasing member and a second biasing member respectively biasing said first and second intensifier pistons toward their first positions.

6. The engine of claim 1 further comprising:

a pressure sensor coupled with said common rail and configured to generate a signal corresponding to a fluid pressure property of said common rail; and a control device coupled with said pressure sensor and with said source of pressurized actuation fluid, said control device being configured to vary an output of said source of pressurized actuation fluid based at least in part on said signal.

7. The engine of claim 6 wherein said source of pressurized actuation fluid comprises a variable displacement pump.

8. The engine of claim 6 wherein said source of pressurized actuation fluid comprises a variable speed pump.

9. The engine of claim 1 comprising a compression ignition engine wherein each of said fuel injectors extends at least partially into one of said cylinders.

10. The engine of claim 9 wherein said source of pressurized actuation fluid includes a first pump, wherein said pressurization device includes a first intensifier chamber associated with a first intensifier piston and a second intensifier chamber associated with a second intensifier piston, and wherein said engine further comprises a fuel transfer pump which is separate from said first pump and fluidly connects with said first and second intensifier chambers.

11. A method of pressurizing a common rail fuel system of an internal combustion engine comprising the steps of:

moving a first intensifier piston via a pressurized actuation fluid;

moving a second intensifier piston via a pressurized actuation fluid;

hydraulically moving a valve between a first position at which it connects the first intensifier piston with a source of pressurized actuation fluid but blocks the second intensifier piston from the source of pressurized actuation fluid and a second position at which it connects the second intensifier piston with the source of pressurized actuation fluid but blocks the first intensifier piston from the source of pressurized actuation fluid;

supplying a fluid to a common rail which is pressurized at least in part via the steps of moving the first and second intensifier pistons; and controlling a fluid pressure in the common rail at least in part by varying a reciprocation speed of the plurality of intensifier pistons via a step of adjusting a flow output of the source of pressurized actuation fluid.

12. The method of claim 11 further comprising a step of controlling moving the valve between its first and second positions at least in part via the steps of moving the first and second intensifier pistons.

13. The method of claim 12 wherein the controlling step further comprises opening and closing drain passages from the valve with the first and second intensifier pistons.

14. The method of claim 11 further comprising the steps of receiving sensor inputs associated with a fluid pressure property of a fluid in the common rail, and controlling an actuation fluid supply pump in a manner which is responsive to the sensor inputs.

15. The method of claim 14 wherein the step of controlling an actuation fluid supply pump includes adjusting a speed of the actuation fluid supply pump.

16. The method of claim 11 further comprising the steps of:

supplying a fluid to be pressurized to the intensifier pistons at a low pressure; and supplying a fluid to actuate the intensifier pistons to the intensifier pistons at a medium pressure;

wherein the step of supplying a fluid to a common rail includes supplying fluid to the common rail at a high pressure.

17. A pressurization device for a common rail fuel system having a common rail, of an internal combustion engines comprising:

a housing having at least one actuation fluid inlet, and at least one outlet;

a first intensifier including a first actuation chamber, and a first piston positioned at least partially within said housing;

a second intensifier including a second actuation chamber, and a second piston positioned at least partially within said housing; and a valve configured to control fluid flow to the first and second intensifiers, said valve having a first position wherein said actuation fluid inlet is in fluid communication with the first actuation chamber but not the second actuation chamber, and a second position wherein said actuation fluid inlet is in fluid communication with the second actuation chamber but not the first actuation chamber, said valve further including at least one pressure control surface for moving said valve between said first and second positions;

wherein the pressurization device is free of electrical actuators within said housing and is configured by way of controlling fluid flow to said intensifiers via said valve to vary a fluid flow from the pressurization device to the common rail in response to a fluid flow rate through said at least one actuation fluid inlet.

18. The pressurization device of claim 17 wherein said valve comprises a shuttle valve having a first hydraulic control surface and a second hydraulic control surface in opposition to said first hydraulic control surface.

19. The pressurization device of claim 17 further comprising a first biasing member associated with said first intensifier and a second biasing member associated with said second intensifier.

20. The pressurization device of claim 17 wherein said housing includes a second fluid inlet separate from said at least one actuation fluid inlet, a high pressure outlet for supplying fluid pressurized by said pressurization device to a common rail, and a low pressure outlet.

* * * * *